US011293442B2

(12) United States Patent
Jeon et al.

(10) Patent No.: US 11,293,442 B2
(45) Date of Patent: Apr. 5, 2022

(54) SCROLL COMPRESSOR HAVING DISCHARGE COVER PROVIDING A SPACE TO GUIDE A DISCHARGE FLOW FROM A DISCHARGE PORT TO A DISCHARGE PASSGAE FORMED BY A PLURALITY OF DISCHARGE HOLES

(71) Applicant: LG ELECTRONICS INC., Seoul (KR)

(72) Inventors: Nayoung Jeon, Seoul (KR); Taekyoung Kim, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 294 days.

(21) Appl. No.: 16/378,653

(22) Filed: Apr. 9, 2019

(65) Prior Publication Data

US 2019/0309753 A1 Oct. 10, 2019

(30) Foreign Application Priority Data

Apr. 9, 2018 (KR) ..... 10-2018-0041123

(51) Int. Cl.
*F04C 29/12* (2006.01)
*F04C 18/02* (2006.01)
(Continued)

(52) U.S. Cl.
CPC ..... *F04C 29/12* (2013.01); *F04C 18/0215* (2013.01); *F04C 23/008* (2013.01);
(Continued)

(58) Field of Classification Search
CPC .... F04C 29/12; F04C 23/008; F04C 29/0035; F04C 29/065; F04C 18/0215; F04C 2270/14; F04C 29/02; F04C 18/0292
See application file for complete search history.

(56) References Cited

U.S. PATENT DOCUMENTS 5,400,611 A * 3/1995 Takeda ..... F25B 49/027 62/158
6,523,455 B1 * 2/2003 Callahan ..... F04B 27/109 92/153
(Continued)

FOREIGN PATENT DOCUMENTS

JP 2015-105635 6/2015
JP 2018-053746 4/2018
(Continued)

OTHER PUBLICATIONS

Korean Notice of Allowance dated May 29, 2019.
European Search Report dated Sep. 3, 2019.

*Primary Examiner* — Mary Davis
*Assistant Examiner* — Paul W Thiede
(74) *Attorney, Agent, or Firm* — Ked & Associates LLP

(57) ABSTRACT

A scroll compressor may include a first scroll and a second scroll orbiting relative to the first scroll to form compression chambers, a discharge port provided in the first scroll to discharge refrigerant compressed in the compression chamber, a discharge passage formed through the first discharged through the discharge to an upper side of the frame, and a discharge cover coupled to the first scroll and having a space to accommodate end portions of the discharge port and the discharge passage to guide the refrigerant discharged through the discharge port to the discharge passage. A volume of a discharge space defined in the space by the first scroll may be 4.5 or more, obtained by dividing a volume of the discharge space by a total volume of an initial compression chamber among the compression chambers.

16 Claims, 8 Drawing Sheets

(51) Int. Cl.

| | |
|---|---|
| ***F04C 23/00*** | (2006.01) |
| ***F04C 29/00*** | (2006.01) |
| ***F04C 29/06*** | (2006.01) |

(52) U.S. Cl.
CPC ..... *F04C 29/0035* (2013.01); *F04C 29/065* (2013.01); *F04C 2270/14* (2013.01)

(56) References Cited

U.S. PATENT DOCUMENTS

| | | | | |
|---|---|---|---|---|
| 9,395,105 | B2 * | 7/2016 | Shimazu | F25B 9/008 |
| 9,920,759 | B2 * | 3/2018 | Sung | F04C 23/008 |
| 2016/0047378 | A1 * | 2/2016 | Choi | F04C 18/0292 418/55.1 |
| 2016/0047380 | A1 | 2/2016 | Kim et al. | |
| 2017/0306964 | A1 | 10/2017 | Kim et al. | |
| 2018/0073505 | A1 | 3/2018 | Choi et al. | |

FOREIGN PATENT DOCUMENTS

| | | |
|---|---|---|
| KR | 10-0446214 | 8/2004 |
| KR | 10-2016-0017993 | 2/2016 |

* cited by examiner

| VOLUME | DISCHARGE SPACE VOLUME (cc) | STROKE VOLUME (cc) | VOLUME RATIO | PULSATION COMPONENT (kgf/cm$^2$) | EFFICIENCY (EER) |
|---|---|---|---|---|---|
| DEFAULT | 161.0 | 62.1 | 2.6 | 2.8 | 10.5 |
| 2 TIMES | 303.0 | 62.1 | 4.9 | 2.0 | 10.67 |
| 4 TIMES | 587.0 | 62.1 | 9.5 | 1.2 | 10.72 |
| 6 TIMES | 871.0 | 62.1 | 14.0 | 0.45 | 10.76 |

SCROLL COMPRESSOR HAVING DISCHARGE COVER PROVIDING A SPACE TO GUIDE A DISCHARGE FLOW FROM A DISCHARGE PORT TO A DISCHARGE PASSGAE FORMED BY A PLURALITY OF DISCHARGE HOLES

CROSS-REFERENCE TO RELATED APPLICATION(S)

Pursuant to 35 U.S.C. § 119(a), this application claims the benefit of an earlier filing date of and the right of priority to Korean Application No. 10-2018-0041123, filed in Korea on Apr. 9, 2018, the contents of which are incorporated by reference herein in its entirety.

BACKGROUND

1. Field

A scroll compressor and a compressor having a compression unit located below a motor unit is disclosed herein.

2. Background

A scroll compressor is a compressor forming a compression chamber including a suction chamber, an intermediate pressure chamber, and a discharge chamber between scrolls while the plurality of scrolls performs a relative orbiting motion in an engaged state. Such a scroll compressor may obtain a relatively high compression ratio as compared with other types of compressors while smoothly connecting suction, compression, and discharge strokes of refrigerant, thereby obtaining stable torque. Therefore, the scroll compressor is widely used for compressing refrigerant in, for example, an air conditioner or other household appliances. Recently, a high-efficiency scroll compressor having a lower eccentric load and an operation speed at 180 Hz or higher has been introduced.

Such a scroll compressor may be divided into an upper compression type and a lower compression type according to the positions of the driving unit or motor and the compression unit or compressor. An upper compression type is configured such that a compression unit is located above a driving unit, whereas a lower compression type is configured such that a compression unit is located below a driving unit.

Generally, in compressors including a high-pressure scroll compressor, a discharge pipe may be provided far away from a compression unit so that oil may be separated from refrigerant in an inner space of a casing. Therefore, an upper compression type high-pressure scroll compressor may have a discharge pipe located between a motor unit and a compression unit, whereas a lower compression type high-pressure scroll compressor may have a discharge pipe at an upper side of a motor unit or motor.

Accordingly, in an upper compression type, refrigerant discharged from a compression unit does not move up to a motor unit but moves toward a discharge pipe in an intermediate space between the motor unit and the compression unit. On the other hand, in a lower compression type, refrigerant discharged from a compression unit flows through a motor unit and moves toward a discharge pipe in an oil separation space formed at an upper side of the motor unit.

In the lower compression type scroll compressor as described above, as the refrigerant may be discharged from the compression unit located at the lower side and move upward, a discharge cover may be provided at a lower side of the compression unit to guide the refrigerant discharged from the compression unit upward. This is disclosed in Korean Patent Publication No. 10-2016-0017993 (Published Date: Feb. 17, 2016), which is hereby incorporated by reference.

As described in the related art, a discharge cover is hermetically coupled to a lower end of a fixed scroll, and the fixed scroll is provided with a scroll-side discharge passage communicating with a discharge space of the discharge cover. The scroll-side discharge passage of the fixed scroll communicates with a frame-side discharge passage penetrating through an upper surface of a main frame. Accordingly, refrigerant discharged from a compression unit to the discharge space of the discharge cover sequentially passes through the scroll-side discharge passage and the frame-side discharge passage, so as to be guided into a space between a motor unit and the compression unit. The refrigerant flows through the motor unit and moves to an upper space.

However, in the lower compression scroll compressor as described above, pressure pulsation occurs as the refrigerant compressed in the compression unit is discharged into the discharge cover. The pressure pulsation interferes with smooth flow of the refrigerant into the discharge passage, thereby lowering compressor efficiency.

In the lower compression type scroll compressor, although the pressure pulsation occurring in the discharge cover differs depending on compressor capacity, a discharge cover with an appropriate size corresponding to capacity of each compressor is not provided and may be difficult to provide, which limits compressor efficiency.

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail of a scroll compressor according to exemplary embodiments disclosed herein, with reference to the accompanying drawings. Hereinafter, for the sake of explanation, description will be given of a type of scroll compressor in which a rotational shaft overlaps an orbiting wrap on the same plane in a lower compression-type scroll compressor having a compression unit located lower than a motor unit. This type of scroll compressor is known to be suitable for application to a refrigeration cycle under high temperature and high compression ratio conditions.

Figure 1:
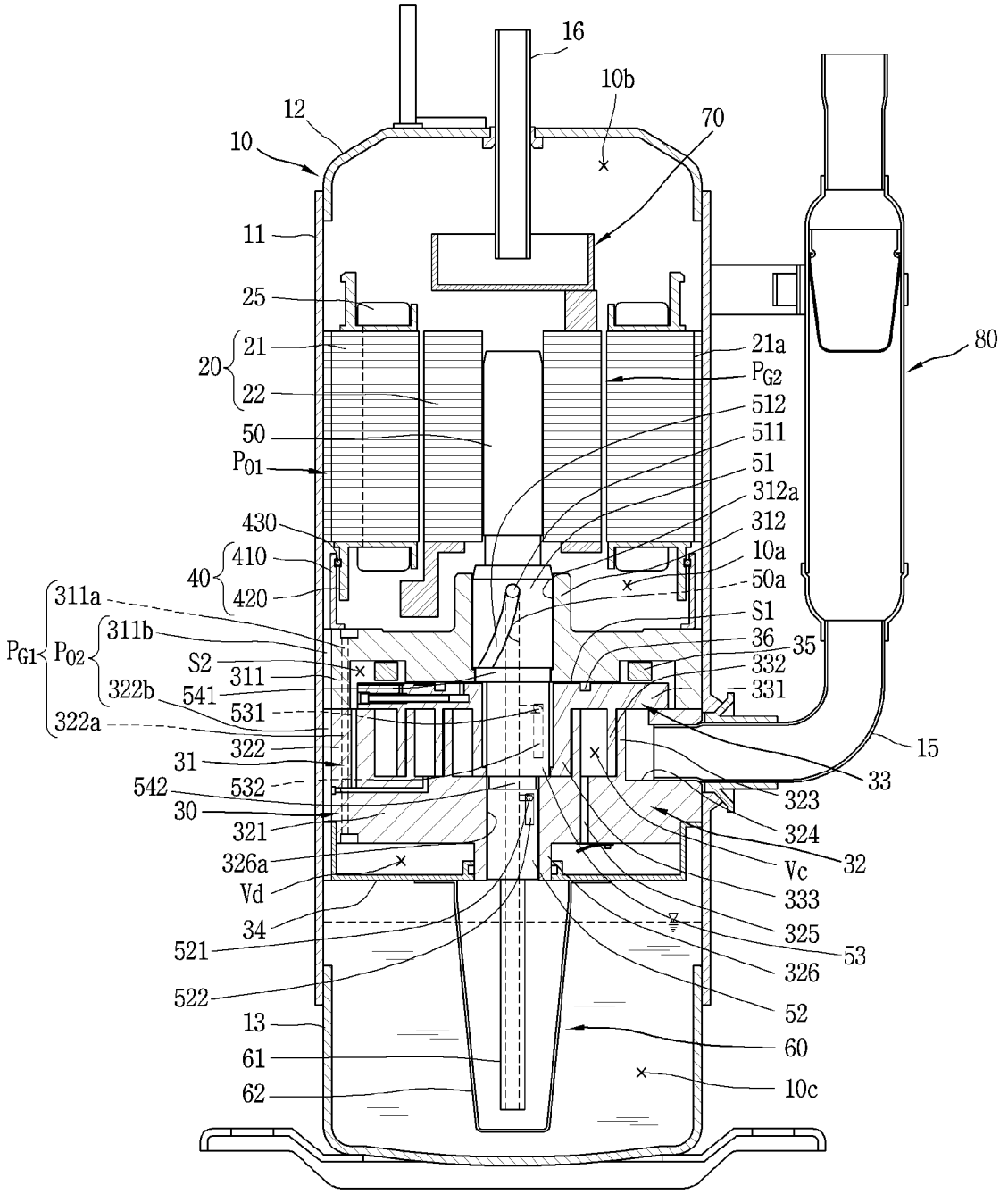
FIG. 1 is a longitudinal sectional view of a lower compression-type scroll compressor in accordance with an embodiment.
Figure 2:
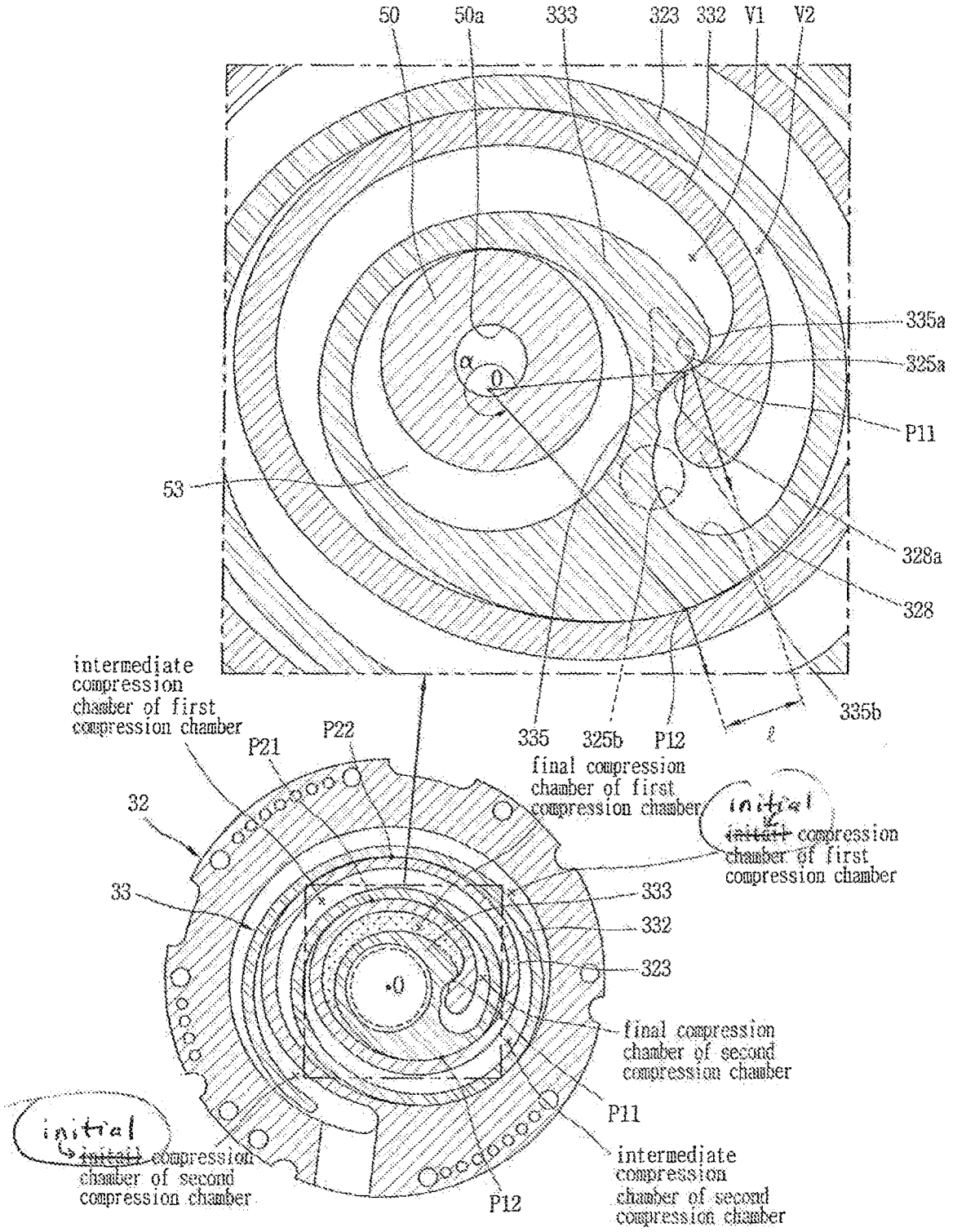
FIG. 2 is a horizontal sectional view of a compression unit in FIG. 1.

FIG. 1 is a longitudinal sectional view of a lower compression-type scroll compressor in accordance with an embodiment. FIG. 2 is a horizontal sectional view of a compression unit in FIG. 1.

Referring to those drawings, a lower compression type scroll compressor may be provided with a motor unit or motor 20 having a driving motor within a casing 10 to generate a rotational force, and a compression unit or device 30 located below the motor unit 20 and having a predetermined space (hereinafter, referred to as an "intermediate space') 10*a* to compress refrigerant via the rotational force of the motor unit 20.

The casing 10 may include a cylindrical shell 11, an upper shell 12 covering an upper portion of the cylindrical shell 11, and a lower shell 13 covering a lower portion of the cylindrical shell 11 and simultaneously forming an oil storage space 10*c*. The cylindrical shell 11, upper shell 12, and lower shell 13 may form a hermetic container.

A refrigerant suction pipe 15 may directly communicate with a suction chamber of the compression unit 30 through a lateral surface of the cylindrical shell 11, and a refrigerant discharge pipe 16 communicating with an upper space 10*b* of the casing 10 may be provided through a top of the upper shell 12. The refrigerant discharge pipe 16 may correspond to a path through which compressed refrigerant discharged from the compression unit 30 to the upper space 10*b* of the casing 10 is discharged to an outside. The refrigerant discharge pipe 16 may extend to a middle of the upper space 10*b* to allow the upper space 10*b* to form a kind of oil separation space. Further, depending on certain circumstances, an oil separator (not shown) that separates oil mixed with refrigerant may be connected to the refrigerant suction pipe 15 within the casing 10 including the upper space 10*b* or within the upper space 10*b*.

The motor unit 20 may include a stator 21 and a rotor 22 rotating within the stator 21. The stator 21 may be provided with teeth and slots forming a plurality of coil winding portions (not shown) on an inner circumferential surface thereof along a circumferential direction, such that a coil 25 is wound therearound. Refrigerant may be discharged into the intermediate space 10*a* between the motor unit 20 and the compression unit 30 through a first discharge passage or an outer passage PG1, which will be described hereinafter. A second discharge passage or an inner passage PG2 may be formed by combining a gap between the inner circumferential surface of the stator 21 and an outer circumferential surface of the rotor 22 with the coil winding portions. Refrigerant discharged into the intermediate space 10*a* may then flow to the upper space 10*b* formed above the motor unit 20 through the second discharge passage PG2 formed in the motor unit 20.

Furthermore, a plurality of D-cut faces 21*a* may be formed on an outer circumferential surface of the stator 21 along the circumferential direction. The plurality of D-cut faces 21*a* may form a first oil passage P01 together with an inner circumferential surface of the cylindrical shell 11 to allow a flow of oil. As a result, oil separated from refrigerant in the upper space 10*b* may flow to the lower space 10*c* through the first oil passage P01 and a second oil passage P02 which will be described hereinafter.

A frame 31 forming the compression unit 30 may be fixedly coupled to an inner circumferential surface of the casing 10 at a predetermined interval below the stator 21. An outer circumferential surface of the frame 31 may be, for example, shrink-fitted to or fixedly welded on an inner circumferential surface of the cylindrical shell 11.

A frame-side partition wall portion or partition wall 311 may be formed in an annular shape on an edge of the frame 31. The frame-side partition wall portion 311 may be provided with a plurality of frame-side discharge holes 311*a* formed axially in a penetrating manner to form the first discharge passage PG1 together with scroll-side discharge holes 322*a* of a first scroll or a fixed scroll 32 to be described hereinafter.

A plurality of oil collecting grooves 311*b* may be formed on an outer circumferential surface of the frame-side partition wall portion 311 in the circumferential direction. The frame-side oil collecting grooves 311*b* may form the second oil passage P02 together with scroll-side oil collecting grooves 322*b* of the first scroll 32.

In addition, a first shaft receiving protrusion or main bearing support 312 that supports a main bearing portion or main bearing 51 of a rotational shaft or shaft 50 which may be formed in a central portion of the frame 31, and a first shaft receiving hole or main bearing hole 312*a* may be formed through the first shaft receiving protrusion 312 so that the main bearing portion 51 of the rotational shaft 50 may be rotatably inserted therein so as to be supported in a radial direction.

Further, a fixed scroll (hereinafter, referred to as a "first scroll") 32 may be provided on a lower surface of the frame 31 with interposing therebetween an orbiting scroll (hereinafter, referred to as a "second scroll") 33 which is eccentrically connected to the rotational shaft 50. The first scroll 32 may be fixedly coupled to the frame 31, but may alternatively be movably coupled to the frame 31 in the axial direction.

The first scroll 32 may be provided with a fixed-side disk portion or fixed disc 321 formed in a substantially disk shape, and a scroll-side sidewall portion or scroll-side sidewall 322 formed at an edge of the fixed-side disk portion 321 and coupled to a lower edge of the frame 31. A suction port 324, through which the refrigerant suction pipe 15 and a suction chamber communicate with each other, may be formed through one side (or portion) of the scroll-side sidewall portion 322. A discharge port 325, which communicates with a discharge chamber and through which compressed refrigerant is discharged, may be formed through a central portion of the fixed-side disk portion 321. The discharge port 325 may be one in number so as to communicate with both of a first compression chamber V1 and a second compression chamber V2 to be described hereinafter. Alternatively, a plurality of the discharge port 325 may be provided to independently communicate with the first and second compression chambers V1 and V2. The discharge port 325 may include a first discharge port 325*a* and a second discharge port 325*b*.

The scroll-side sidewall portion 322 may be provided with a plurality of scroll-side discharge holes 322*a* communicating with the frame-side discharge holes 311*a* so as to form the first discharge passage PG1 together with the frame-side discharge holes 311*a*.

The scroll-side sidewall portion 322 may be provided with the scroll-side oil collecting groove 322*b* formed on an outer circumferential surface thereof. The scroll-side oil collecting groove 322*b* may communicate with the frame-side oil collecting groove 311*b* so as to form the second oil passage P02 together with the frame-side oil collecting groove 311*b*. Accordingly, oil collected may be guided into the lower space 10*c* along the second oil passage P02. The second oil passage P02 may be provided between the frame 31 and the casing 10 and between the first scroll 32 and the casing.

Further, a discharge cover 34 that guides refrigerant discharged from a compression chamber Vc to a passage guide described hereinafter may be coupled to a lower side of the first scroll 32. The discharge cover 34 may be formed such that a discharge space Vd thereof described hereinafter may receive the discharge ports 325*a*, 325*b* and simultaneously receive an inlet of the first discharge passage PG1 to guide refrigerant discharged from the compression chamber Vc through the first and second discharge ports 325*a*, 325*b* to the upper space 10*b* of the casing 10 between the motor unit 20 and the compression unit 30. The discharge cover 34 will be described hereinafter together with the first discharge passage P01.

Further, a fixed wrap 323 engaging with an orbiting wrap 332 to form the compression chamber Vc may be formed on an upper surface of the fixed-side disk portion 321. The fixed wrap 323 will be described hereinafter together with the orbiting wrap 332.

In addition, a second shaft receiving protrusion or sub-bearing support 326 that supports a sub bearing 52 of the rotational shaft 50 may be formed in the center of the fixed-side disk portion 321, and a second shaft receiving hole or a sub bearing hole 326*a* that supports the sub bearing 52 in the radial direction may be formed through the second shaft receiving protrusion 326 in the axial direction.

A second scroll 33 may be provided with an orbiting-side disk portion or orbiting disc 331 formed in a substantially disk shape. The orbiting wrap 332 forming the compression chamber Vc in engagement with the fixed wrap 331 may be formed on a lower surface of the orbiting-side disk portion 331.

The orbiting wrap 332 may be formed in an involute or evolvent shape together with the fixed wrap 323, but may also be formed in various other shapes. For example, as illustrated in FIG. 2, the orbiting wrap 332 may have a shape in which a plurality of arcs having different diameters and origins is connected, and the outermost curve may be formed in a substantially elliptical shape having a major axis and a minor axis. The fixed wrap 323 may be formed in a similar manner.

A rotational shaft coupling portion or an inner region 333 which forms an inner end or inner portion of the orbiting wrap 332 and in which an eccentric portion or an eccentric shaft 53 of the rotational shaft 50 is rotatably inserted may be formed through a central portion of the orbiting-side disk portion 331 in the axial direction.

An outer circumference of the rotational shaft coupling portion 333 may be connected to the orbiting wrap 332 to form the compression chamber Vc together with the fixed wrap 323 during a compression process.

Further, the rotational shaft coupling portion 333 may be formed at a height corresponding to or overlapping the orbiting wrap 332 on the same plane, and thus the eccentric portion 53 of the rotational shaft 50 may be formed at a height corresponding to or overlapping the orbiting wrap 332 on the same plane. Accordingly, repulsive force and compressive force of refrigerant are attenuated by each other while being applied to the same plane based on the orbiting-side disk portion 331, thereby preventing an inclination of the second scroll 33 due to an action of the compressive force and repulsive force.

In addition, the rotational shaft coupling portion 333 may be provided with a concave portion 335 formed on an outer circumference facing an inner end portion or end of the fixed wrap 323 and engaged with a protruding portion or protrusion 328 of the fixed wrap 323 which will be described hereinafter. At one side of the concave portion 335, an increasing portion 335*a* may be formed on an upstream side along a forming direction of the compression chamber Vc to increase a thickness from an inner circumference to an outer circumference of the rotational shaft coupling portion 333. This may extend a compression path of the first compression chamber V1 immediately before discharge, and consequently the compression ratio of the first compression chamber V1 may be increased to be close to a pressure ratio of the second compression chamber V2. The first compression chamber V1 may be a compression chamber formed between an inner surface of the fixed wrap 323 and an outer surface of the orbiting wrap 332, and will be described hereinafter separately from the second compression chamber V2.

Another side of the concave portion 335 may have an arcuate compression surface 335*b* having an arcuate shape. A diameter of the arcuate compression surface 335*b* may depend on a thickness of an inner end portion or inner end (i.e. a discharge end) of the fixed wrap 323 and an orbiting radius of the orbiting wrap 332. When the thickness of the inner end portion of the fixed wrap 323 increases, a diameter of the arcuate compression surface 335*b* may be increased. As a result, a thickness of the orbiting wrap 332 around the arcuate compression surface 335*b* may increase to ensure durability, and the compression path may extend to increase the compression ratio of the second compression chamber V2 to that extent.

In addition, the protruding portion 328 protruding toward the outer circumference of the rotational shaft coupling portion 333 may be formed adjacent to an inner end portion or inner end (i.e., a suction end or starting end) of the fixed wrap 323 corresponding to the rotational shaft coupling portion 333. The protruding portion 328 may be provided with a contact portion 328*a* protruding therefrom and engaged with the concave portion 335. The inner end or inner end portion of the fixed wrap 323 may be formed to have a larger thickness than other portions. As a result, wrap strength at the inner end portion of the fixed wrap 323, which is subjected to the highest compressive force on the fixed wrap 323, may increase so as to enhance durability.

The compression chamber Vc may be formed between the fixed-side disk portion 321 and the fixed wrap 323 and the orbiting wrap 332 and the orbiting-side disk portion 331. A suction chamber, an intermediate pressure chamber, and a discharge chamber may be formed consecutively along a proceeding direction of the wraps.

As illustrated in FIG. 2, the compression chamber Vc may include the first compression chamber V1 formed between an inner surface of the fixed wrap 323 and an outer surface of the orbiting wrap 332, and the second compression chamber V2 formed between an outer surface of the fixed wrap 323 and an inner surface of the orbiting wrap 332. The first compression chamber V1 may be or include a compression chamber formed between two contact points P11 and P12 generated in response to the inner surface of the fixed wrap 323 being brought into contact with the outer surface of the orbiting wrap 332. The second compression chamber V2 may be or include a compression chamber formed between two contact points P21 and P22 generated in response to the outer surface of the fixed wrap 323 being brought into contact with the inner surface of the orbiting wrap 332.

When two lines that connect a center of the eccentric portion 53 (i.e., a center O of the rotational shaft coupling portion 333) to the two contact points P11 and P12, respectively may define an angle $\alpha$ between the lines, $\alpha$ within the first compression chamber V2. Just before discharge, the angle $\alpha$ may be at least large, but less than 360° (i.e., $\alpha<360°$), and a distance l between normal vectors at the two contact points P11, P12 also has a value greater than zero.

As a result, the first compression chamber V1 immediately before discharge may have a smaller volume as compared to a case where a fixed wrap 323 and an orbiting wrap have a shape of an involute or evolvent curve. Therefore, the compression ratios of the first and second compression chambers V1 and V2 may be improved even without increasing the sizes of the fixed wrap 323 and the orbiting wrap 332.

The second scroll 33 may be orbitally provided between the frame 31 and the fixed scroll 32. An Oldham ring 35 that prevents rotation and allows orbiting of the second scroll 33 may be provided between an upper surface of the second scroll 33 and a lower surface of the frame 31, and a sealing member or seal 36 that forms a back pressure chamber S1 explained hereinafter may be provided at an inner side near the sealing member 36 rather than closer to an outer side near the Oldham ring 35.

An intermediate pressure space is formed on an outside of the sealing member 36. The intermediate pressure space may communicate with an intermediate compression chamber Vc, and thus, may be filled with refrigerant of intermediate pressure so as to serve as a back pressure chamber. Therefore, a back pressure chamber formed at an inside with respect to the sealing member 36 may be referred to as a "first back pressure chamber" S1, and an intermediate pressure space formed at an outside may be referred to as a "second back pressure chamber" S2. As a result, the back pressure chamber S1 may be a space formed by a lower surface of the frame 31 and an upper surface of the second scroll 33 based on the sealing member 36.

An upper portion of the rotational shaft 50 may be press-fitted into the center of the rotor 22 while a lower portion thereof is coupled to the compression unit 30 to be supported in the radial direction. Accordingly, the rotational shaft 50 may transfer a rotational force of the motor unit 20 to the orbiting scroll 33 of the compression unit 30. Then, the second scroll 33 eccentrically coupled to the rotational shaft 50 may perform an orbiting motion with respect to the first scroll 32.

A main bearing (hereinafter, referred to as a "first bearing") 51 may be formed at a lower portion of the rotational shaft 50 to be inserted into a first bearing hole 312*a* of the frame 31 and supported in the radial direction, and a sub-bearing (hereinafter, referred to as a "second bearing") 52 may be formed at a lower side of the first bearing 51 to be inserted into a second bearing hole (or center-shaft receiving hole) 326*a* of the first scroll 32 and supported in the radial direction. Further, the eccentric portion 53 may be provided between the first bearing 51 and the second bearing 52 in a manner of being inserted into a rotational shaft coupling portion 333.

The first bearing 51 and the second bearing 52 may be coaxially formed to have the same axial center, and the eccentric portion 53 may be eccentrically formed in the radial direction with respect to the first bearing 51 or the second bearing 52. The second bearing 52 may be eccentrically formed with respect to the first bearing 51.

Further, an oil supply passage 50*a* that supplies oil to each bearing 51 and 52 and the eccentric portion 53 may be formed within the rotational shaft 50 along the axial direction. As the compression unit 30 may be located below the motor unit 20, the oil supply passage 50*a* may be formed from a lower end of the rotational shaft 50 to approximately a lower end or a middle height of the stator 21 or a position higher than an upper end of the first bearing 51 in a grooving manner. Depending on the circumstance, the oil supply passage 50*a* may also be formed by penetrating through the rotational shaft 50 in the axial direction.

There may be first and second passages 521 and 522 provided in the sub-bearing 52, first and second eccentric portion passages 531 and 532 provided in the eccentric portion 53, and first and second main bearing passages 511 and 512 provided in the main bearing 51. The oil supply passage 50*a* may communicate with the first and second sub-bearing passages 521 and 522 to supply oil to the sub-bearing 52, first and second eccentric passages 531 and 532 to supply oil to the eccentric portion 53, and the first and second main bearing passages 511 and 512 to supply oil to the main bearing 51. Further, there may be a first support or seal 541 provided between the main bearing 51 and the eccentric portion 53, and a second support or seal 542 provided between the sub bearing 52 and the eccentric portion 53.

In addition, an oil feeder 60 that pumps up oil filled in the lower space or oil storage space 10*c* may be coupled to the lower end of the rotational shaft 50 at a lower end of the second bearing 52. The oil feeder 60 may include an oil supply pipe 61 inserted into the oil supply passage 50*a* of the rotational shaft 50, and a blocking member 62 that blocks an introduction of foreign materials by receiving the oil supply pipe 61 therein. The oil supply pipe 61 may be located to be immersed in oil of the lower space 10*c* through the discharge cover 34.

A passage separation unit or passage separator 40 may be provided in the intermediate space (hereinafter, referred to as a "first space") 10*a* to prevent refrigerant discharged from the compression unit 30 from interfering with oil flowing from the upper space (hereinafter, referred to as a "second space") 10*b* of the motor unit 20. The second space 10*b* may be an oil separation space to the lower space (hereinafter, referred to as a "third space") 10*c* of the compression unit 30, which may be an oil storage space.

The passage separation unit 40 may include a passage guide which divides the first space 10*a* into a refrigerant flow space in which refrigerant flows and an oil flow space in which oil flows. The passage guide may include a first passage guide 410 protruding upward in the axial direction from the upper surface of the frame 31, a second passage guide 420 protruding downward in the axial direction from the lower surface of the motor unit 20, and a sealing portion or seal 430 provided between the first and second passage guides 410 and 420 to seal a gap between an inner space and an outer space of the passage guides 410 and 420.

Each of the first passage guide 410 and the second passage guide 420 may be provided with a single annular wall portion or a plurality of annular wall portions or annular walls. The second passage guide 420 may be assembled to the stator 21 of the motor unit 20 or extend from an insulator coupled to the stator 21.

The sealing portion 430 may be an O-ring interposed between an inner surface of the first passage guide 410 and an outer surface of the second passage guide 420 facing the inner surface of the first passage guide 410. Although not shown, the sealing portion may alternatively be formed by coupling the first passage guide 410 and the second passage guide 420 in a concave-convex manner or in a stepped manner. An upper end of the first passage guide 410 or a lower end of the second passage guide 420 may be closely adhered on or inserted into the stator 21 or the frame 31. In this case, one passage guide may be provided.

The scroll compressor may include an oil separation unit or oil separator 70, and an accumulator 80. The oil separator 70 may separate oil mixed with refrigerant, and may be connected to the refrigerant discharge pipe 16 within the upper space 10*b*.

A lower compression type scroll compressor according to an embodiment operates as follows. When power is applied to the motor unit 20, rotational force is generated and the rotor 22 and the rotational shaft 50 are rotated by the rotational force. As the rotational shaft 50 rotates, the orbiting scroll 33 eccentrically coupled to the rotational shaft 50 may orbit due to the Oldham ring 35.

Then, refrigerant supplied from an outside of the casing 10 through the refrigerant suction pipe 15 may be introduced into the compression chamber Vc, and may be compressed as a volume of the compression chamber Vc is reduced by the orbiting motion of the orbiting scroll 33. The refrigerant is then discharged into an inner space of the discharge cover 34 through the first discharge port 325*a* and the second discharge port 325*b*.

Noise may be reduced from the refrigerant discharged into the inner space of the discharge cover 34 while the refrigerant circulates within the inner space of the discharge cover 34, The noise-reduced refrigerant flows to a space between the frame 31 and the stator 21, and then is introduced into the upper space 10*b* of the motor unit 20 through a gap between the stator 21 and the rotor 22.

Oil is separated from the refrigerant in the upper space 10*b* of the casing 10. Accordingly, the refrigerant is discharged out of the casing 10 through the refrigerant discharge pipe 16, while the oil is collected back into the lower space 10*c* as the oil storage space of the casing 10 through a passage between the inner circumferential surface of the casing 10 and the stator 21 and a passage between the inner circumferential surface and the outer circumferential surface of the compression unit 30. This series of processes may be repeated. The passage separation unit 40 may be provided between the motor unit 20 and the frame 31 to separate a discharge passage, through which refrigerant and oil are discharged, from an oil passage that collects or recovers oil separated from refrigerant in the upper space 10*b* into the lower space 10*c*, Accordingly, the refrigerant and the oil may be discharged and collected without being mixed with each other.

The discharge cover 34 may reduce pressure pulsation of refrigerant and oil discharged through the discharge port 325 and simultaneously connect the discharge port 325 and the first discharge passage PG1. Therefore, an inner volume of the discharge cover 34 (i.e., a volume of the discharge space Vd) may be closely related to efficiency of the compressor.

For example, when the volume of the discharge space Vd is smaller than a proper value, the effect of reducing the pressure pulsation may be reduced by half, and even the narrow volume of the discharge space Vd may act as a kind of flow resistance, which may result in lowering efficiency of the compressor. On the other hand, when the volume of the discharge space Vd is larger than a proper value, pressure pulsation may be lowered and flow resistance to the discharged refrigerant and oil may be reduced, so that the refrigerant may smoothly move to the inner space of the casing 10. Therefore, it is important to optimize the volume of the discharge space Vd to improve the efficiency of the compressor.

Figure 3:
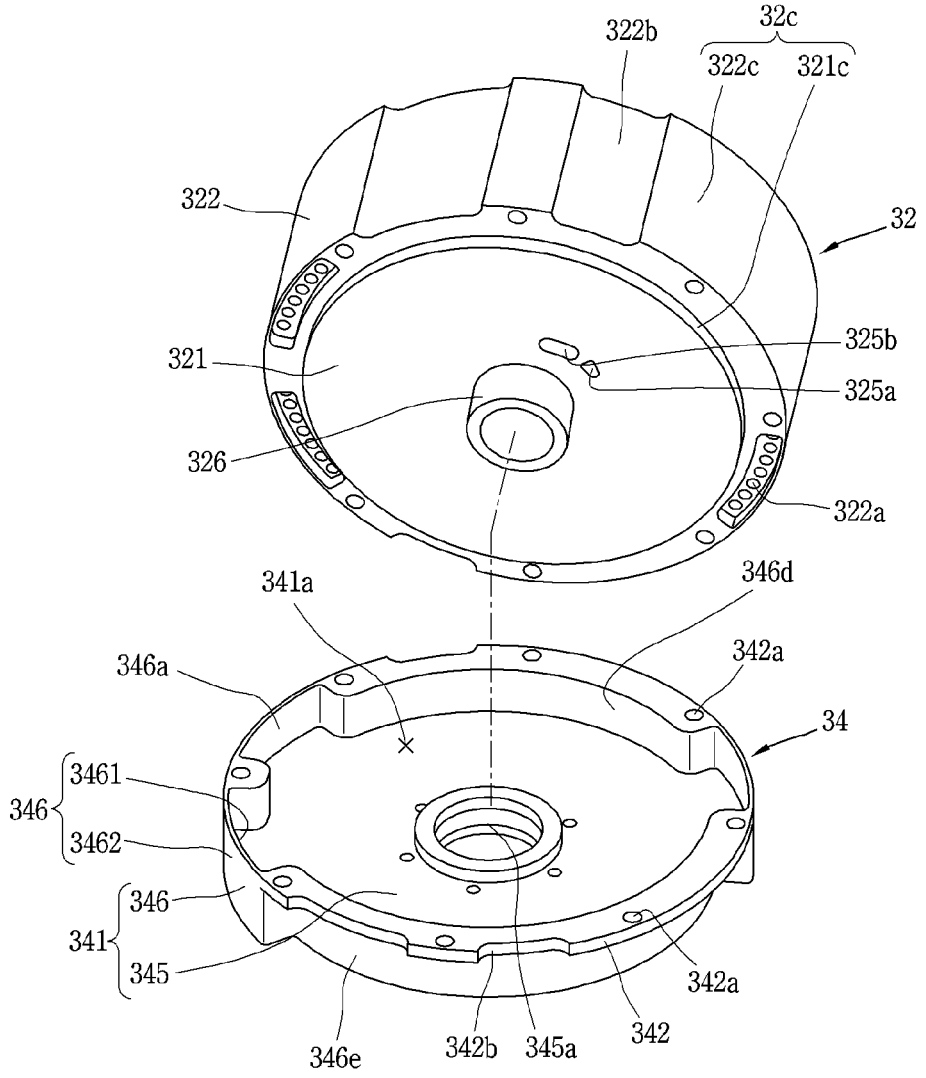
FIG. 3 is a perspective view illustrating a fixed scroll and a discharge cover detached from a compression unit in accordance with an embodiment.
Figure 4:
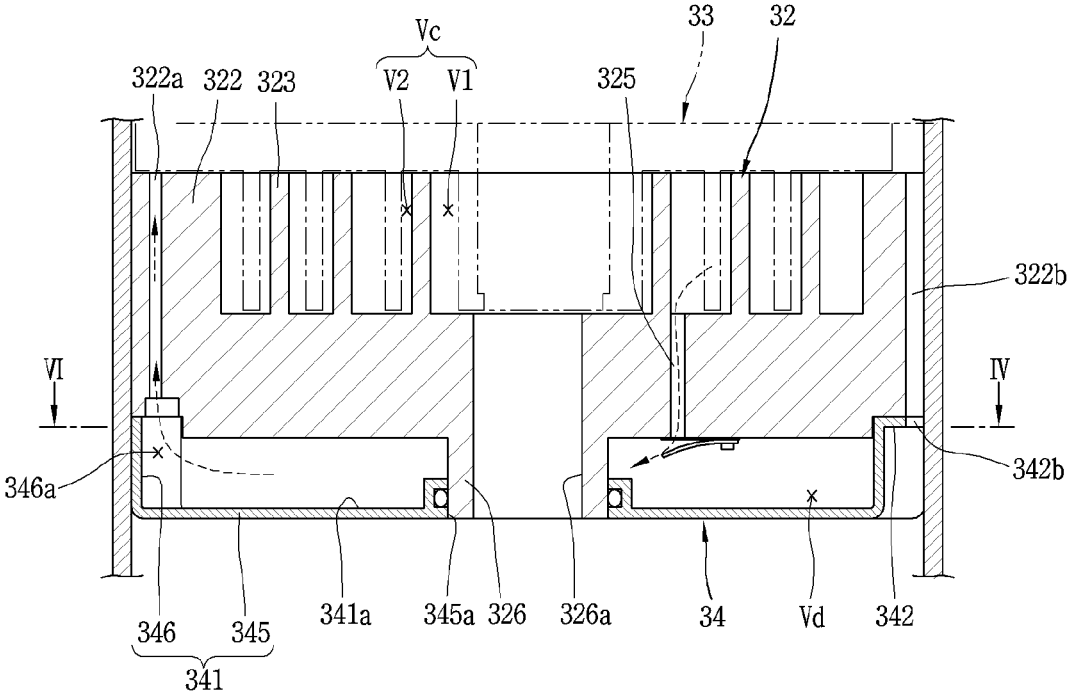
FIG. 4 is an enlarged sectional view illustrating a compression unit in accordance with an embodiment.

Referring to FIGS. 3 and 4, the discharge cover 34 may be formed in a cap-like shape and may include a housing portion or housing 341 having a space part or recess 341*a* forming a discharge space Vd together with the first scroll 32, and a flange portion or flange 342 extending outward from an outer circumferential surface 3462 of the side wall 346 of the housing portion 341 and coupled to the first scroll 32. The space part 341*a* may also be referred to as an "inner space" of the discharge cover 34. The discharge space Vd includes the space part 341*a*.

The housing portion 341 may include a first surface or bottom surface 345 formed substantially flat to form a bottom surface, and a second surface or side surface (side wall) 346 extending axially from the first surface 345 in a substantially annular shape to form a side wall surface or radial side wall. Accordingly, the first surface 345 and an inner surface 3461 of the side wall 346 form the space part 341*a* to accommodate a lower end of the discharge port 325 and a lower end of the scroll-side discharge hole 322*a*, and the space part 341a may form the discharge space Vd together with a surface of the first scroll 32 inserted into the space part 341*a*.

A through hole 345*a* may be formed through a central portion of the first surface 345. The through hole 345*a* may be inserted with a second shaft receiving protrusion 326, which protrudes downward (axially) from a rear or bottom surface of the first scroll 32 at the fixed-side disk portion 321. A sealing member or seal (not shown) that seals a gap between an inner circumferential surface of the through hole 345*a* and an outer circumferential surface of the second shaft receiving protrusion 326 may be formed on the inner circumferential surface of the through hole 345*a*.

Figure 5:
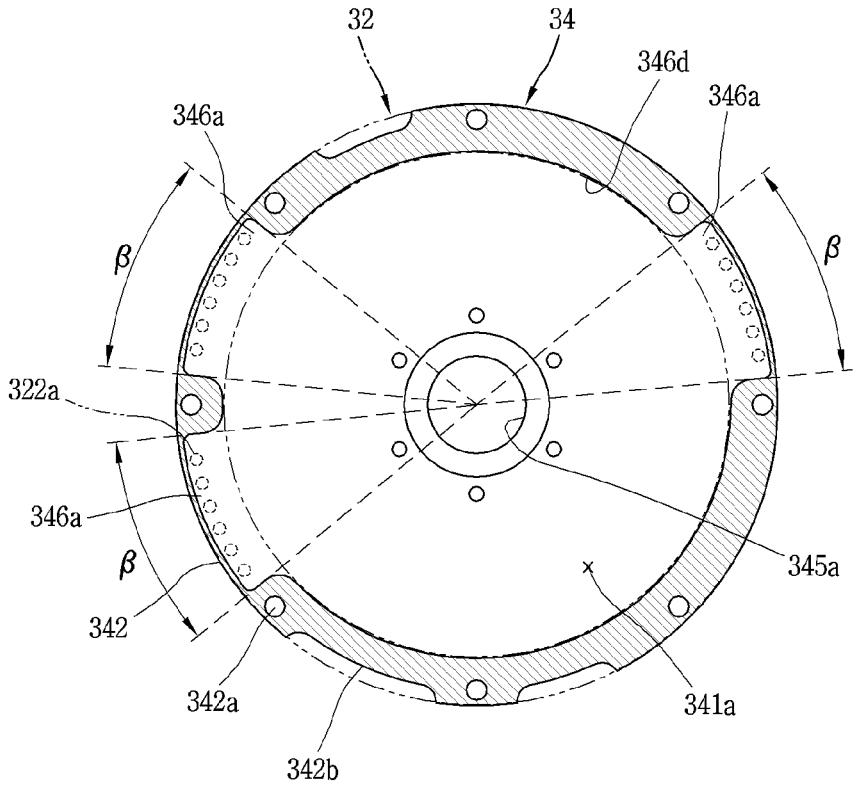
FIG. 5 is a sectional view taken along the line "1V-IV" of FIG. 4.

As illustrated in FIGS. 3-5, at least one discharge guide groove 346*a* may be formed in the inner surface 3461 of the side wall 346 along the circumferential direction. The discharge guide groove 346*a* may be formed to be recessed outward in the radial direction, and the scroll-side discharge hole 322*a* constituting the first discharge passage PG1 may be formed to be positioned inside the discharge guide groove 346*a*. Accordingly, the inner surface 3461 of the side wall 346 of the housing portion 341 excluding the discharge guide grooves 346*a* may form a sealing portion or seal 346*d* as an inner surface 3461 of the side wall 346 is closely adhered on an outer circumferential surface 32*c* of the first scroll 32, namely, an outer circumferential surface 321*c* of the fixed-side disk portion 321. An inner surface of the discharge cover 34 may include the inner surface 3461 of the side wall 346 and the first surface 345. As shown in FIG. 3, the inner surface 3461 of the side wall 346 may align, in a radial direction, with an outer circumferential surface 3462 of the side wall 346 of the discharge cover 34 such that the inner surface 3461 is opposite the outer circumferential surface 3462.

Referring to FIG. 5, an entire circumferential angle 3 of the discharge guide groove 346*a* with respect to a center of the discharge cover 34 may be formed to be smaller than or equal to an entire circumferential angle with respect to the inner circumferential surface of the discharge space Vd except for the discharge guide grooves 346*a*. That is, an arc length of the discharge guide groove 346*a* may be equal to or smaller than an arc length of the rest of the inner circumference of the discharge cover. In this manner, the inner circumferential surface of the discharge space Vd except for the discharge guide groove 346*a* may secure not only a sufficient sealing area but also a circumferential length for forming the flange portion 342.

The flange portion 342 may extend radially from an outer circumferential surface of a portion defining a sealing area or part, (i.e., a portion excluding the discharge guide grooves 346*a*) of the second surface 346 of the housing portion 341. The flange portion 342 may be provided with coupling holes 342*a* that couple the discharge cover 34 to the first scroll 32 with bolts, and a plurality of oil collecting grooves 342*b* formed between the neighboring coupling holes 342*a* in the circumferential direction. The oil collecting grooves 342*b* may be formed to be recessed inward (toward a center) from an outer circumferential surface of the flange portion 342 in the radial direction.

The discharge space Vd provided in the discharge cover 34 may be formed to have a predetermined volume or more in consideration of the pressure pulsation, as described above, so that efficiency of the compressor may be increased. Therefore, the volume of the discharge space Vd may be proportional to a volume of the compression chamber Vc. If the volume of the compression chamber Vc is large, pressure pulsation of refrigerant discharged from the compression chamber Vc may be large. Conversely, if the volume of the compression chamber Vc is small, the pressure pulsation of the refrigerant discharged from the compression chamber Vc may become small. The volume of the discharge space Vd may be formed proportional to an area of the discharge port 325. However, as the area of the discharge port 325 may also be proportional to the volume of the compression chamber Vc, the volume of the discharge space Vd may be suitably decided in proportion to the volume of the compression chamber Vc.

As the scroll compressor may form a pair of compression chambers V1 and V2, the volume of the compression chamber Vc may be a sum of the volumes of the first and second compression chambers V1 and V2. The compression chamber Vc of the scroll compressor may be formed in a manner where an initial compression chamber is formed at an outer side, a final compression chamber is formed in a central side, and a continuously moving intermediate compression chamber is formed between the initial compression chamber and the final compression chamber. Thus, the volume of the compression chamber Vc may refer to a volume of the initial compression chamber.

Figure 6:
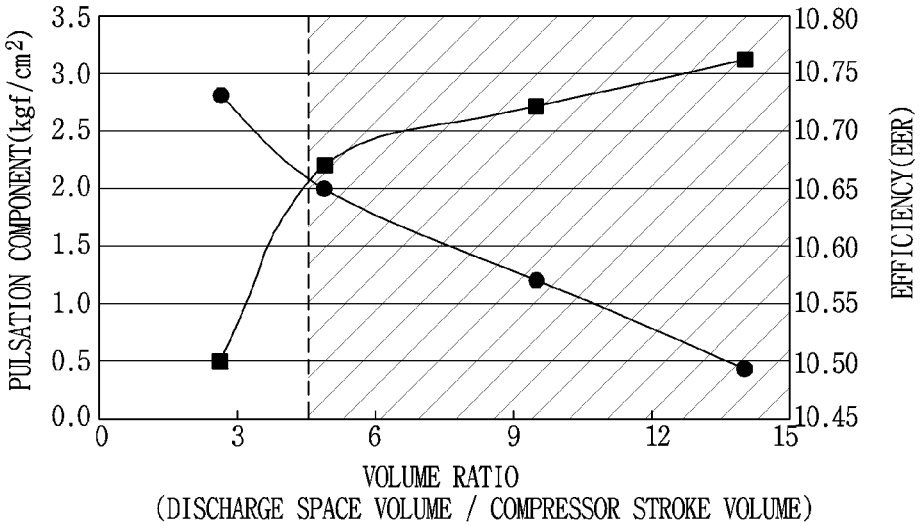
FIG. 6 is a graph showing comparison results between a pulsation component and compressor efficiency according to a volume ratio in a discharge cover in accordance with an embodiment.

FIG. 6 is a graph showing comparison results between a pulsation component and compressor efficiency according to a volume ratio in a discharge cover 34 in accordance with an embodiment. In the graph, a value obtained by dividing the volume of the discharge space Vd by a total volume (stroke volume of the compressor) of the initial compression chamber Vc is referred to as a "volume ratio", and the compressor efficiency is compared with a pulsation component on the basis of the volume ratio. Thus, the volume of the discharge space Vd is optimally set based on the comparison results.

Referring to the graph shown in FIG. 6, it may be seen that the pulsation component is drastically changed at a volume ratio of about 3.5 to 5.5. That is, in a region where the volume ratio is 3.5 to 5.5 or less, the pulsation component sharply drops as the volume ratio increases. In a region where the volume ratio exceeds 3.5 to 5.5, the drop is gradually reduced. Therefore, if the discharge volume is set so that the volume ratio is 3.5 to 5.5 or less, the pulsation component may not be sufficiently reduced. Therefore, the volume ratio may set to be 3.5 to 5.5 or more in consideration of the pressure pulsation.

In addition, it may be seen that the compressor efficiency is remarkably changed based on the volume ratio of 4 to 6. That is, in a region where the volume ratio is 4 to 6 or less, the efficiency of the compressor increases sharply as the volume ratio increases. In a region where the volume ratio exceeds 4 to 6, the increase is gradually slowed down. Therefore, if the discharge volume is set so that the volume ratio is 4 to 6 or less, the compressor efficiency may not be sufficiently improved. Therefore, the volume ratio may be set to be 4 to 6 or more in consideration of the compressor efficiency.

As described above, as the pressure pulsation and the compressor efficiency are related to each other in the compressor, the volume ratio may be set in consideration of both the pressure pulsation and the compressor efficiency. In other words, the volume ratio may be optimized in view of both pressure pulsation and compressor efficiency. In this case, the volume ratio may be set to be about 3.5 to 6 or more, or about 4.5 or more.

As described above, an appropriate volume ratio may be calculated on the basis of the total volume of the initial compression chamber, and thus, an optimal volume of the discharge space Vd may be calculated, which may result in easily providing an appropriate size of the discharge cover 34 in correspondence to capacity of the compressor.

Alternatively, only a lower limit may be set for an appropriate volume ratio of the discharge space Vd of the discharge cover 34, This is because it is more advantageous when the pressure pulsation is lower and the compressor efficiency is higher. Therefore, a sufficiently relevant limitation may be achieved merely by the lower limit of the volume ratio.

Figure 7:
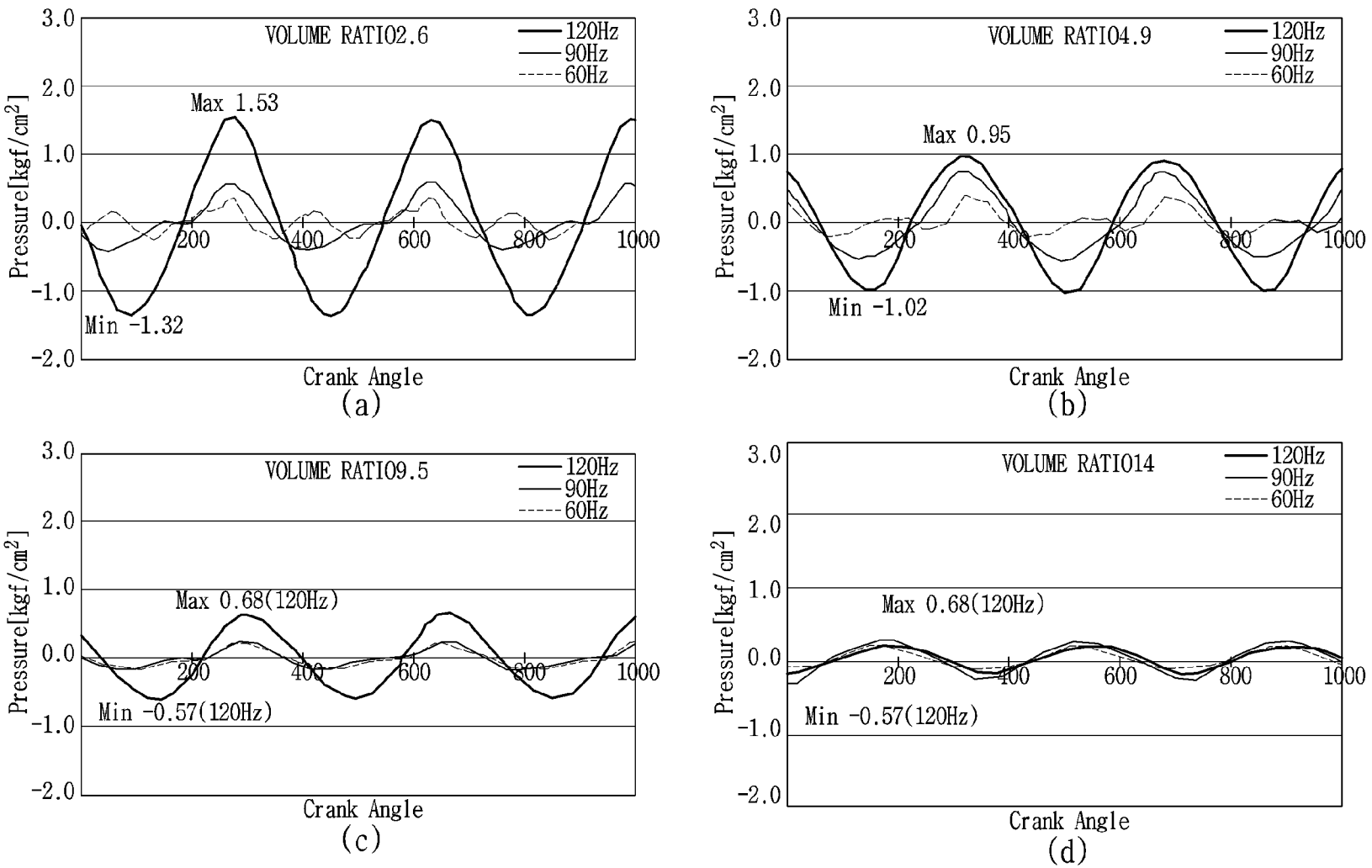
FIG. 7 is a graph showing comparison results of pressure pulsation (dynamic pressure) according to variation of a volume ratio in a scroll compressor in accordance with an embodiment.
Figures 8, 9:
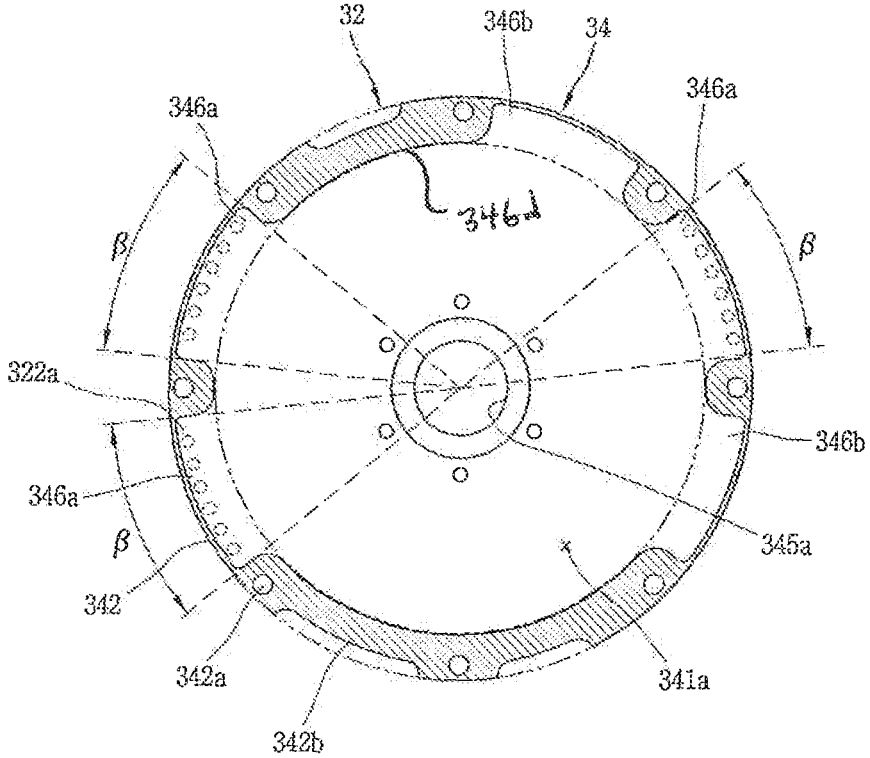
FIG. 8 is a table summarizing pulsation components and efficiencies for each size of a discharge volume and a volume of a compression chamber according to FIG. 7.
FIG. 9 is a planar view illustrating another embodiment of a discharge cover according to an embodiment.

However, the pressure pulsation and the compressor efficiency may not be affected by the volume ratio or may be converged to a state where such affection is meaningless at a certain time point. FIG. 7 is a graph showing comparison results of pressure pulsation (dynamic pressure) according to variation of a volume ratio in a scroll compressor in accordance with an embodiment. FIG. 8 is a table summarizing pulsation components and efficiencies for each size of a discharge volume and a volume of a compression chamber according to FIG. 7.

As illustrated in (a) to (d) of FIG. 7, it may be seen that a dynamic pressure component or range is about 2.8 kgf/cm2 when the compressor operates at 120 Hz in a volume ratio of 2.6 (in view (a)), but the dynamic pressure component is changed to about 2.0 kgf/cm2 at the volume ratio of 4.9 (view (b)), to about 1.2 kgf/cm2 at the volume ratio of 9.5 (view (c)), and to about 0.4 kgf/cm2 at the volume ratio of 14.0 (view (d)). This shows that the dynamic pressure component is different in size but the volume ratio increases even when the operation speed is 90 Hz or 60 Hz, but the dynamic pressure component is decreased as the volume ratio increases. As a result, it may be seen that a reduction ratio of the dynamic pressure component with respect to the volume ratio is the largest at around the volume ratio of 4.9. In particular, when the volume ratio is increased to 14.0, the dynamic pressure component is close to almost zero. Thus, the dynamic pressure component may become the same at all operating conditions regardless of the operation speed. Therefore, considering the pressure pulsation, an upper limit of the volume ratio may be set to 14.0.

Referring to FIG. 8, it may be seen that the compressor efficiency increases as the volume ratio increases. In particular, it may be seen that the compressor efficiency is increased by 0.17 when the volume ratio increases from 2.6 to 4.9, increased by 0.05 when the volume ratio increases from 4.9 to 9.5, and increased by 0.04 when the volume ratio increases from 9.5 to 14.0. As a result, the greatest increase of the compressor efficiency is seen when the volume ratio is about 4.9. Particularly, considering that the increase of the compressor efficiency is greatly slowed down while the volume ratio is increased from 9.5 to 14.0, it may be predicted that the compressor efficiency is not greatly improved but will be converged to a specific value even if the volume ratio increases more.

Therefore, limiting the upper limit value of the volume ratio may be advantageous because an optimum compressor efficiency may be expected while appropriately maintaining the size of the compressor. Considering the test result, the upper limit value of the volume ratio may be set to about 15 or less.

Hereinafter, description will be given of another embodiment of a discharge cover in reference to FIG. 9. In the foregoing embodiment, the discharge guide groove 346*a* may be formed on the inner wall surface or an inner wall (i.e., in the second surface 346) of the discharge cover 34 to be recessed outward along the radial direction, and the first discharge passage of the first scroll 32 may be accommodated in the discharge guide groove 346*a*. In this case, the inner wall surface of the discharge cover 34 excluding the discharge guide groove 346*a* may be brought into contact with the outer circumferential surface of the first scroll 32 so as to form the sealing portion.

However, as illustrated in FIG. 9, in addition to the discharge guide grooves 346*a*, grooves 346*b* which may be recessed outward along the radial direction may be further formed in the inner wall surface of the discharge cover 34. This groove 346*b* may be referred to as a "space expansion groove". FIG. 9 is a planar view illustrating another embodiment of a discharge cover.

The space expansion groove 346*b*, similar to the discharge guide groove 346*a*, may be spaced apart from the outer circumferential surface of the first scroll 32, and may not be brought into contact with the first scroll 32, thereby not forming a sealing portion. As the scroll-side discharge hole 322*a* may not be accommodated in the space expansion groove 346*b*, the space expansion groove 346*b* may be a space formed to enlarge the volume of the discharge space Vd.

The volume of the discharge space Vd may be enlarged without increasing a depth (axial length) of the discharge cover 34, thereby securing an appropriate volume of the discharge space Vd and reducing the size of the compressor. Further, as the space expansion groove 346*b* may also attenuate pressure pulsation, the pressure pulsation may be further reduced.

Figure 10:
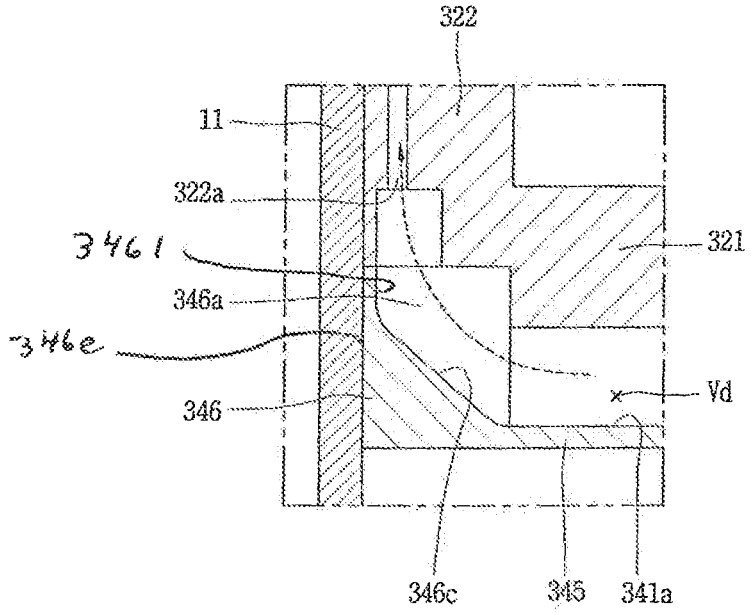
FIG. 10 is an enlarged sectional view illustrating an inside of a discharge guide groove in a discharge cover in accordance with an embodiment.

Hereinafter, description will be given of still another embodiment of a discharge cover 34. In the foregoing embodiments, the inner surface of the discharge guide groove 346*a* may be bent into a substantially right-angle shape. However, in another embodiment, a guide surface 346*c* (FIG. 10) may be formed on the inner surface of the discharge guide groove 346*a* so that refrigerant discharged into the discharge space Vd may be quickly guided to the discharge passage. FIG. 10 is an enlarged sectional view illustrating an inside of a discharge guide groove 346*a* in a discharge cover 34 in accordance with an embodiment.

As illustrated in FIG. 10, the housing portion 341 of the discharge cover 34 may be provided with a first surface 345 forming a bottom surface and a second surface 346 extending from an outer circumferential surface of the first surface 345 to form a sidewall surface and having a flange portion 342 on an outer circumferential surface thereof. At least one discharge guide groove 346*a* may be formed on the second surface 346 in a manner of being recessed outward in the radial direction.

Accordingly, the discharge guide groove 346*a* may be formed to have a predetermined volume by the first surface 345 and the second surface 346, and a discharge guide surface 346*c* which is upwardly inclined to outside along the radial direction is formed at a point where the first surface 345 and the second surface 346 meet.

The discharge guide surface 346*c* may be formed to have an inclination angle of about 45° and the scroll-side discharge hole 322*a* is formed to be located within a range of the discharge guide surface 346*c* in the axial direction.

As described above, when the discharge guide groove 346*a* is provided with the inclined discharge guide surface 346*c*, refrigerant discharged into the discharge space Vd may move to the scroll-side discharge hole 322*a* along the discharge guide surface 346*c*. As the scroll-side discharge hole 322*a* may be formed in a direction substantially opposite to the discharge port 325, a flowing direction of refrigerant may be sharply bent in order for the refrigerant discharged from the discharge hole 325 to move to the scroll-side discharge hole 322*a*, causing a flow resistance. However, when the inclined discharge guide surface 326*c* is formed on the discharge guide groove 326*a*, a flow angle of the refrigerant may be reduced, so that the refrigerant may move to the scroll side discharge hole 322*a* more quickly. Therefore, even if the volume ratio with respect to the discharge space Vd is somewhat reduced, the pressure pulsation of the refrigerant may be lowered and the compressor efficiency may be improved accordingly.

Embodiments disclosed herein may provide a scroll compressor, capable of enhancing compressor efficiency by effectively reducing pressure pulsation of refrigerant discharged from a compression unit to a discharge cover. The scroll compressor may include a discharge cover with an appropriate size corresponding to capacity of a compressor.

Embodiments disclosed herein may provide a scroll compressor, capable of enhancing compressor efficiency without excessively increasing a size of the compressor by optimizing a volume of a discharge space with respect to a stroke volume of the compressor.

Embodiments disclosed herein may provide a scroll compressor, configured such that a compression unit having compression chambers is provided below a motor unit, discharge passages provided in the compression unit and the motor unit to guide discharged refrigerant to an upper side of the motor unit, and a discharge cover forming a discharge space provided at a lower portion of the compression unit to guide refrigerant discharged from the compression chambers to the discharge passages, wherein a volume of the discharge space may change in proportion to a suction volume of the compression chamber. The volume of the discharge space may be determined by comparing pressure pulsation in the discharge space with compressor efficiency based on a value obtained by dividing the volume of the discharge space by a total volume of an initial compression chamber of the compression chambers. The volume of the discharge space may have a value of 4.5 or more, and the value may be obtained by dividing the volume of the discharge space by the volume of the initial compression chamber.

Embodiments disclosed herein may provide a scroll compressor including a casing, a driving motor fixed to an inner space of the casing and having an inner passage and an outer passage penetratingly formed in an axial direction, a rotational shaft coupled to the driving motor to be rotatable, a frame provided below the driving motor with a space therebetween and supporting the rotating shaft inserted therethrough, a first scroll provided on a lower side of the frame and having a fixed wrap formed on one surface thereof, a second scroll provided between the frame and the first scroll having an orbiting wrap engaged with the fixed wrap having the rotational shaft eccentrically coupled thereto in a manner of overlapping the orbiting wrap in a radial direction, and forming compression chambers together with the first scroll while performing an orbiting motion with respect to the first scroll, a discharge port provided in the first scroll, a discharge passage formed through the first scroll, and a discharge cover coupled to the first scroll and having a space part that accommodates an end portion of the discharge port and an end portion of the discharge passage so that the refrigerant discharged through the discharge port may be guided to the discharge passage. The space part of the discharge cover may have a discharge space defined therein by the first scroll, and the discharge space may have a volume of 4.5 or more, a value obtained by dividing the volume of the discharge space by a stroke volume defined as a total volume of the initial compression chamber among the compression chambers.

The discharge cover may be coupled to the first scroll in a manner that an inner circumferential surface thereof constituting the discharge space is inserted into an outer circumferential surface of the first scroll, and the discharge cover may be provided with at least one discharge guide groove recessed in the inner circumferential surface thereof toward an outer circumferential surface along a circumferential direction, and spaced apart from the outer circumferential surface of the first scroll.

The discharge passage may be formed in a range of the discharge guide groove. The discharge guide groove may be provided with at least one space expansion groove formed on one surface thereof in the circumferential direction, and the discharge passage may be formed out of a range of the space expansion groove.

The discharge guide groove may have an entire circumferential angle smaller than or equal to an entire circumferential angle with respect to an inner circumferential surface of the discharge space excluding the discharge guide groove. The discharge guide groove may be provided with a guide surface that is inclined in a direction toward a radial side surface forming the discharge guide groove.

Here, the discharge cover may include a housing portion forming a discharge space and a flange portion extending from an outer circumferential surface of the housing portion and coupled to the first scroll. The housing portion may be provided with at least one discharge guide groove recessed outward in a side wall surface thereof along the circumferential direction, and the discharge passage may be located inside the discharge guide groove.

The housing portion may be provided with a sealing portion or seal on a portion, except for the discharge guide groove, of the side wall surface thereof, and the sealing portion may be closely adhered on the outer circumferential surface of the first scroll. The flange portion extending from an outer circumferential surface of the sealing portion may be provided with an oil collecting groove recessed in an outer circumferential surface thereof toward a center by a predetermined depth.

The first scroll and the frame may be provided with oil passages communicating spaces of both sides in the axial direction of the first scroll and the frame, and the oil passages may communicate with the oil collecting groove. The frame and the driving motor may be provided with a passage separation unit therebetween, and the passage separation unit may be provided between the discharge passage and the oil passage in the radial direction. The passage separation unit may include a first passage guide extending from the frame, a second passage guide extending from the driving motor, and a sealing portion provided between the first passage guide and the second passage guide.

A scroll compressor may include a casing having an inner space in which oil is stored, a driving motor provided in the inner space of the casing, a rotational shaft coupled to the driving motor, a frame provided at one side of the driving motor and having a frame-side discharge passage formed therethrough in an axial direction, a first scroll having a discharge port formed at one side of the frame and having a scroll-side discharge passage formed therethrough in an axial direction so as to communicate with a frame-side discharge passage, and a second scroll provided between the frame and the first scroll to form compression chambers with the first scroll while performing an orbiting motion with respect to the first scroll. The compression chambers may include an initial compression chamber formed at an outer side, a final compression chamber formed at an inner side, and at least one intermediate compression chamber between the initial compression chamber and the final compression chamber. A discharge cover may be coupled to the first scroll and include a space part that accommodates an end portion of the discharge port and an end portion of the discharge passage so that the refrigerant discharged through the discharge port is guided to the discharge passage. The discharge space may have a volume defined in the space part of the discharge cover by the first scroll, and the volume may be larger than an entire volume of the first compression chamber.

The discharge space may have a volume ratio of 4.5 or more under assumption that the volume ratio is a value obtained by dividing the volume of the discharge space by the entire volume of the initial compression chamber. The volume ratio may be 15 or less.

A scroll compressor may set an appropriate inner volume of a discharge cover which guides refrigerant discharged from a compression unit to a discharge passage, thereby lowering pulsation pressure of the refrigerant discharged from the compression unit and improving efficiency of the compressor accordingly. A scroll compressor may have an inner volume of a discharge cover designed in proportion to a stroke volume of the compressor, which may allow an appropriate inner volume of the discharge cover to be easily provided in correspondence with capacity of the compressor, which may result in standardizing a design of a compressor of high efficiency. Furthermore, as an inner volume of a discharge cover may be set properly, compressor efficiency may be improved while maintaining an appropriate size of the compressor.

It will be understood that when an element or layer is referred to as being "on" another element or layer, the element or layer may be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" may encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments may be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a motor provided in an inner space of the casing and having an inner passage and an outer passage penetrating the motor in an axial direction;

a shaft rotatably coupled to the motor;

a frame provided below the motor such that a space is provided between the frame and the motor, and the shaft penetrates the space and is supported by the frame;

a first scroll provided at a lower side of the frame, the first scroll having a fixed wrap formed on a surface of the first scroll, and a discharge port and a discharge passage formed through the first scroll;

a second scroll provided between the frame and the first scroll having an orbiting wrap engaged with the fixed wrap, wherein the shaft is provided within and coupled to the second scroll to overlap the orbiting wrap in a radial direction, and compression chambers are formed between the second scroll and the first scroll as the second scroll orbits with respect to the first scroll; and a discharge cover coupled to the first scroll and having a recess to accommodate an end of the discharge port and an end of the discharge passage so that the refrigerant discharged through the discharge port is guided to the discharge passage, wherein a discharge space is provided between the discharge cover and the first scroll, and the discharge space has a volume ratio of 4.5 or more, the volume ratio obtained by dividing a volume of the discharge space by a volume of an initial compression chamber among the compression chambers, wherein the discharge cover comprises:

a housing forming the discharge space, wherein the housing is provided with at least one discharge guide groove and a sealing portion, the at least one discharge guide groove being recessed outward in an inner surface of a side wall of the housing and the sealing portion being a portion of the inner surface that does not include the discharge guide groove and that contacts an outer circumferential surface of the first scroll; and a flange extending from an outer circumferential surface of the housing and coupled to the first scroll, wherein:

a portion of the flange that extends from the outer circumferential surface of the housing at a position defining the sealing portion is provided with at least one oil collecting groove recessed by a predetermined depth, the discharge passage communicates with the discharge guide groove, and the first scroll and the frame are provided with a plurality of oil passages penetrating the first scroll and the frame in an axial direction, and the oil passages communicate with the at least one oil collecting groove.

2. The scroll compressor of claim 1, wherein the discharge passage has a position that corresponds to a position of the discharge guide groove so as to communicate with the discharge guide groove.

3. The scroll compressor of claim 2, wherein the discharge cover is provided with at least one space expansion groove recessed in the inner surface of the side wall of the housing toward an outer circumferential surface of the side wall of the housing to be spaced apart from the outer circumferential surface of the first scroll, and wherein a position of the discharge passage does not correspond to a position of the space expansion groove.

4. The scroll compressor of claim 3, wherein the discharge guide groove has an arc length that is smaller than or equal to a total arc length of a portion of the inner surface of the side wall of the housing that does not include the discharge guide groove.

5. The scroll compressor of claim 1, wherein the discharge guide groove is provided with a guide surface that is inclined from a radial side surface of the discharge cover toward a bottom surface of the discharge cover.

6. The compressor of claim 1, wherein a passage separator is formed by the frame and the motor and provided between the discharge passage and the oil passage in the radial direction.

7. The compressor of claim 6, wherein the passage separator comprises:

a first passage guide extending from the frame;

a second passage guide extending from the motor; and a seal provided between the first passage guide and the second passage guide.

8. A scroll compressor, comprising:

a casing having an inner space in which oil is stored;

a motor provided in the inner space of the casing;

a shaft coupled to the motor;

a frame provided at a side of the motor and having a frame-side discharge passage penetrating the frame in an axial direction;

a first scroll having at least one discharge port formed at a side of the frame and having a scroll-side discharge passage penetrating the first scroll in an axial direction so as to communicate with the frame-side discharge passage;

a second scroll provided between the frame and the first scroll to form compression chambers together with the first scroll while orbiting with respect to the first scroll, the compression chambers including an initial compression chamber formed at an outer side, a final compression chamber formed at an inner side, and at least one intermediate compression chamber between the initial compression chamber and the final compression chamber; and a discharge cover coupled to the first scroll and having a recess to accommodate an end of the discharge port and an end of the discharge passage so that the refrigerant discharged through the discharge port is guided to the discharge passage, wherein a first volume defined by the recess and the first scroll is larger than a second volume of the initial compression chamber, wherein:

an outer circumferential surface of the first scroll is inserted into an inner surface of the discharge cover, the discharge cover is provided with at least one discharge guide groove recessed in an inner surface of a side wall of the discharge cover toward an outer circumferential surface of the side wall to be spaced apart from the outer circumferential surface of the first scroll, the inner surface of the side wall of the discharge cover being opposite the outer circumferential surface of the side wall, and the discharge passage has a position that corresponds to a position of the discharge guide groove so as to communicate with the discharge guide groove.

9. The compressor of claim 8, wherein a volume ratio defined by dividing the first volume by the second volume is at least 4.5.

10. The compressor of claim 9, wherein the volume ratio is 15 or less.

11. A compressor, comprising:

a casing;

a motor provided inside the casing, the motor having a rotor and a stator;

a compression device;

an intermediate space provided between the compression device and the motor; and a shaft coupled to the motor and penetrating the intermediate space to transfer a drive force of the motor to the compression device, wherein the compression device includes:

a compression chamber;

a discharge cover having a recess;

a discharge space defined by the discharge cover and a lower surface of the compression device, wherein the discharge space includes the recess;

a plurality of discharge ports to discharge compressed refrigerant from the compression chamber to the discharge space; and a first discharge passage to connect the intermediate space and the discharge space, wherein:

the discharge cover is configured to guide refrigerant discharged from the plurality of discharge ports to the discharge passage, the discharge space has a first volume, the compression chamber has a second volume, and a volume ratio of the first volume and the second volume is predetermined, an outer circumferential surface of a fixed scroll of the compression device is inserted into an inner surface of a side wall of the discharge cover, the discharge cover includes at least one discharge guide groove recessed in the inner surface of the side wall toward an outer circumferential surface of the side wall to be spaced apart from the outer circumferential surface of fixed scroll, wherein the inner surface of the side wall of the discharge cover being opposite an outer circumferential surface of the side wall, and the discharge passage has a position that corresponds to a position of the at least one discharge guide groove so as to communicate with the at least one discharge guide groove.

12. The compressor of claim 11, wherein the second volume is predetermined to set the volume ratio at 4.5 or greater.

13. The compressor of claim 11, further including an upper space provided above the motor, and a second discharge passage provided between the rotor and the stator to connect the upper space and the intermediate space.

14. The compressor of claim 11, wherein the compression device further includes:

a frame fixed to the casing;

the fixed scroll having a fixed wrap, the plurality of discharge ports, and the discharge passage; and an orbiting scroll that orbits via the drive force and having an orbiting wrap extending toward the fixed scroll to engage with the orbiting wrap, wherein the compression chamber is provided between the fixed wrap and the orbiting wrap, and wherein the discharge space is defined by the discharge cover and the fixed scroll.

15. The compressor of claim 11, wherein the discharge cover is eccentrically coupled with the compression device and includes the at least one discharge guide groove that communicates with the first discharge passage.

16. The compressor of claim 15, wherein a first oil passage is formed between the stator and the casing, a second oil passage is formed between the compression device and the casing, the discharge cover includes at least one oil collecting groove, and wherein the first oil passage communicates with the second oil passage, and the second oil passage communicates with the at least one oil collecting groove.

* * * * *